US007021739B2

(12) United States Patent
Burke et al.

(10) Patent No.: US 7,021,739 B2
(45) Date of Patent: Apr. 4, 2006

(54) INK JET PROCESSES

(75) Inventors: Edward F. Burke, Lake Oswego, OR (US); Barry D. Reeves, Lake Oswego, OR (US); David L. Knierim, Wilsonville, OR (US); James B. Jensen, Woodburn, OR (US); Brent R. Jones, Tualatin, OR (US); David D. Martenson, Oregon City, OR (US); Lee D. Hills, Sherwood, OR (US)

(73) Assignee: Xerox Corporation, Stamford, CT (US)

( * ) Notice: Subject to any disclaimer, the term of this patent is extended or adjusted under 35 U.S.C. 154(b) by 252 days.

(21) Appl. No.: 10/721,842

(22) Filed: Nov. 24, 2003

(65) Prior Publication Data

US 2005/0110817 A1 May 26, 2005

(51) Int. Cl.
*B41J 29/393* (2006.01)

(52) U.S. Cl. ..... 347/19

(58) Field of Classification Search ..... 347/19, 347/78, 81

See application file for complete search history.

(56) References Cited

U.S. PATENT DOCUMENTS

| | | | | |
|---|---|---|---|---|
| 5,625,390 | A | 4/1997 | Burke et al. | 347/41 |
| 6,010,205 | A | 1/2000 | Billet | |
| 6,217,148 | B1 | 4/2001 | Adler et al. | |
| 6,270,187 | B1 * | 8/2001 | Murcia et al. | 347/43 |
| 6,347,855 | B1 * | 2/2002 | Takanaka | 347/19 |
| 6,364,447 | B1 | 4/2002 | Boleda et al. | 347/19 |
| 6,370,277 | B1 | 4/2002 | Borrey et al. | 382/260 |
| 6,398,342 | B1 | 6/2002 | Neese et al. | 347/40 |
| 6,439,686 | B1 | 8/2002 | Glass | 347/40 |
| 6,512,596 | B1 * | 1/2003 | Lapstun | 358/1.9 |
| 6,547,361 | B1 | 4/2003 | Suzuki et al. | |
| 2002/0101602 | A1 * | 8/2002 | Vilanova et al. | 358/1.14 |
| 2003/0151634 | A1 * | 8/2003 | DeBusschere et al. | 347/7 |

FOREIGN PATENT DOCUMENTS

| | | |
|---|---|---|
| EP | 1 332 882 A1 | 8/2003 |
| WO | WO 03/008195 A1 | 1/2003 |

* cited by examiner

*Primary Examiner*—K. Feggins
*Assistant Examiner*—Rene Garcia, Jr.
(74) *Attorney, Agent, or Firm*—Oliff & Berridge, PLC

(57) ABSTRACT

Disclosed are methods for compensating for failed ink jets in an ink jet apparatus. The method in embodiments determines if one or more ink jets are nonfunctioning or have failed and substitutes for the one or more nonfunctioning ink jets by using one or more operational ink jets. The operational ink jets used are neighboring operational ink jets that fill in for the one or more failed ink jets. The one or more failed ink jets are disabled wherein a primary image pass is performed followed by one or more additional imaging passes to fill in for the one or more disabled ink jets by enabling the one or more neighboring operational ink jets. The additional imaging passes may be a right fill imaging pass, a left fill imaging pass or a combination of both.

16 Claims, 8 Drawing Sheets

INK JET PROCESSES

BACKGROUND

The present method in embodiments generally relates to ink jet printing. More particularly, the present method relates to detecting one or more improperly functioning ink jets and compensating for the improperly functioning ink jets with the remaining operational ink jets.

In ink jet printing, usually each jet of a print head within a printer is assigned the role of ejecting ink, as necessary, onto pre-specified areas which is currently in a jet's respective print zone. However, a jet sometimes improperly functions, fails, or substantially fails, that is the jet is unable to properly emit ink drops, examples of which may be due to either being clogged or electrical problems in its firing circuitry. When this occurs, the pre-specified areas that are assigned to the failed jet are not printed upon or not printed on properly. If one or more jets fail, the quality of the printed image may suffer and in some instances not be acceptable to a number of sources. Therefore, a need exists that allows for the end user of a printer to detect and enable software to substitute failed jets quickly, enabling continued operation of the printer with acceptable print quality. The ability of the end user to immediately substitute failed or improperly functioning jets may also allow more flexibility in the timing of a service call to repair the printer, since the printer has acceptable print quality. Redundancy, replace-ability and disposability are all common methods of using components that are unreliable or that wear out to build commercially successful products. Use of a jet substitution mode may be appropriate for print head technology, due for example, or in part to the long overall head life and the very large number of jets per head.

SUMMARY

Disclosed are methods for compensating for failed, substantially inoperative, ink jets in an ink jet apparatus. The method in embodiments determines if one or more ink jets have improperly functioned and compensates for the one or more improperly functioning ink jets by using one or more operational ink jets. The operational ink jets used are neighboring operational ink jets that fill in for the one or more improperly functioning ink jets. The one or more improperly functioning ink jets are disabled wherein a primary image pass is performed followed by one or more additional imaging passes to fill in for the one or more disabled ink jets by enabling the one or more neighboring operational ink jets. The additional imaging passes may be a right fill imaging pass, a left fill imaging pass or a combination of both.

BRIEF DESCRIPTION OF THE DRAWINGS

The drawings are not to scale and are only for purposes of illustration.

DETAILED DESCRIPTION

Figure 1:
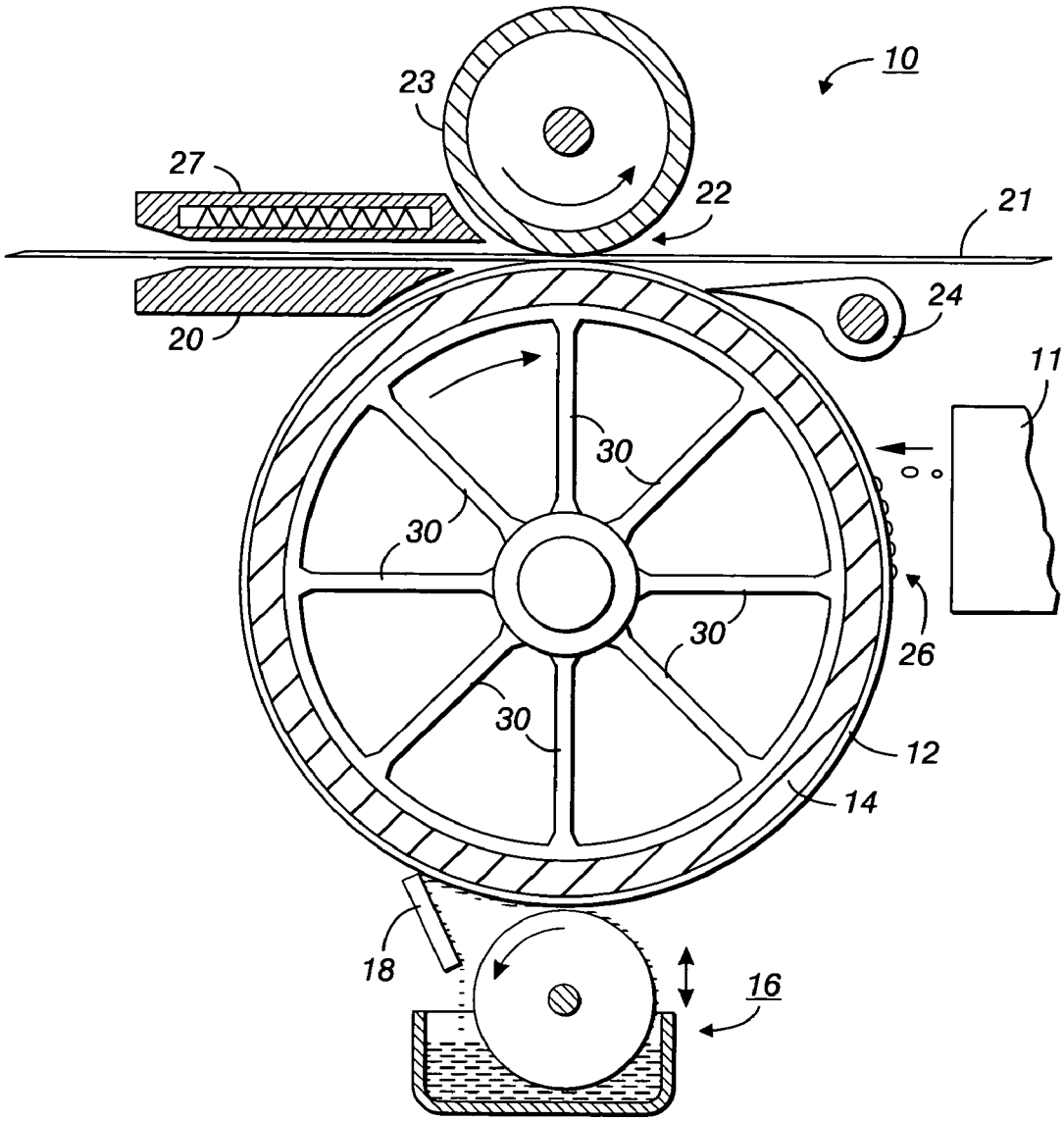
FIG. 1 is a block diagram of the components of an ink jet printer system.
Figure 2:
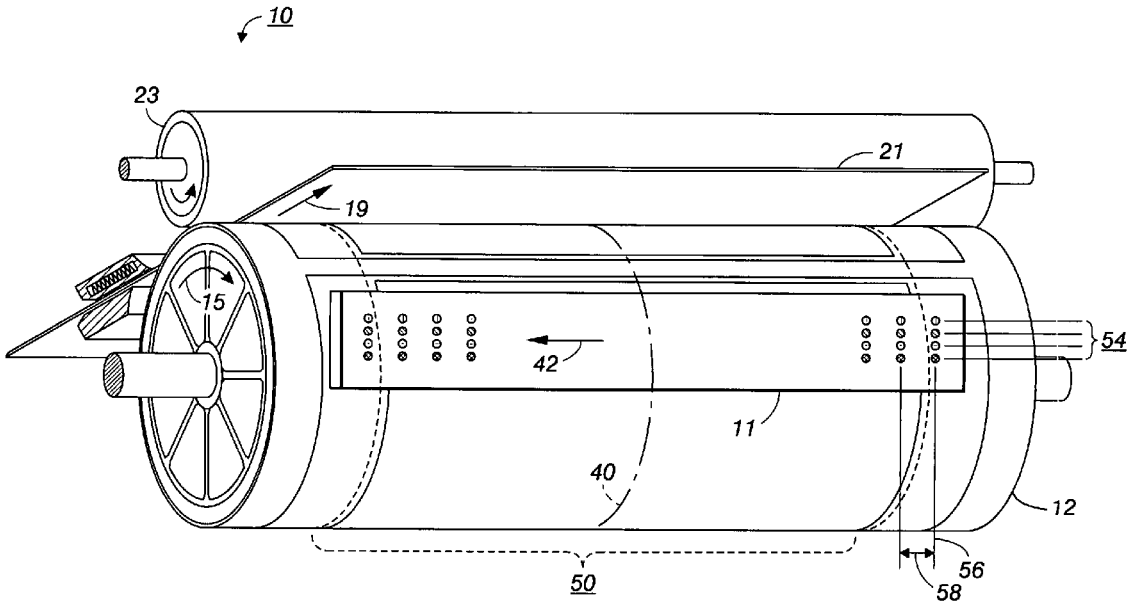
FIG. 2 illustrates an isometric view of the ink jet printer system shown in FIG. 1.

Methods are disclosed for detecting if at least one jet in a device has failed to function or is improperly functioning and substituting the jet with at least one operational ink jet. The methods disclosed herein for detecting and substituting non-functional ink jets may be designed for use in printers, such as solid ink color printers but may also be used in other printing technologies using an array of imaging elements. The printer uses an offset printing process and piezoelectric print head technology that jets molten solid ink. FIGS. 1 and 2 show an imaging apparatus 10 subassembly for a printer utilized in this process to transfer an inked image from an intermediate transfer surface to a final receiving substrate. A print head 11 is supported by an appropriate housing and support elements (not shown) for either stationary or moving utilization to place an ink in the liquid or molten state on a supporting intermediate transfer surface 12 that is applied to a supporting surface 14. Intermediate transfer surface 12 is a liquid layer that is applied to supporting surface 30, such as a drum, band, platen, or other suitable design, by contact with an applicator, such as a metering blade, roller, web, or wicking pad contained within an applicator or blade metering assembly 16.

Applicator assembly 16 optionally contains a reservoir 18 for liquid application and most preferably contains a roller to periodically present oil to the drum 30. Applicator apparatus 16 is mounted for retractable movement upward into contact with the surface of drum 14 and downwardly out of contact with the surface of the drum 14 and its intermediate transfer surface or liquid layer 12 by means of an appropriate mechanism, such as a cam, an air cylinder, or an electrically actuated solenoid (not shown).

In this process, a solid or hot melt, ink is placed into a heated reservoir (not shown) where it is maintained in a liquid state. This highly engineered ink is formulated to meet a number of constraints, including low viscosity at jetting temperatures, specific viscoelastic properties at drum-to-media transfer temperatures, and high durability at room temperatures. Once within the printhead 11, the liquid ink flows through manifolds to be ejected from microscopic orifices through use of piezoelectric transducer (PZT) printhead technology. The duration and amplitude of the electrical pulse applied to the PZT is very accurately controlled so that a repeatable and precise pressure pulse can be applied to the ink, resulting in the proper volume, velocity, and trajectory of the droplet 26. The individual droplets 26 of ink are jetted onto the liquid layer 12, which is supported by a rotating drum 30. The drum 30 and liquid layer 12 are held at a specified temperature with the use of a drum heater (not shown) such that the ink hardens to a ductile viscoelastic state. After the entire image has been jetted onto the liquid layer 12 on the drum surface 14, it is transferred and fixed, or transfixed, onto pre-heated receiver media 21 (paper, transparency, etc). A high durometer synthetic pressure roller 23, when placed against the drum 14, develops a high-pressure nip 22 that compresses the paper and ink together, spreads the ink droplets 26, and fuses the ink droplets 26 into the media 21.

Referring once again to FIGS. 1 and 2, a final substrate guide 20 and media preheater 27 passes a final receiving substrate 21, such as paper, from a positive feed device (not shown) and guides it through a nip 22 formed between the opposing actuated surfaces of a roller 23 and intermediate transfer surface 12 supported by drum 30. Stripper fingers or blades 24 (only one of which is shown) may be pivotally mounted to imaging apparatus 10 to assist in removing final receiving substrate 21 from intermediate transfer surface 12. Roller 23 has a metallic core, preferably steel, with an elastomeric covering and engages final receiving substrate 21 on a reverse side to which an ink image 26 is transferred from intermediate transfer surface 12.

Figure 3:
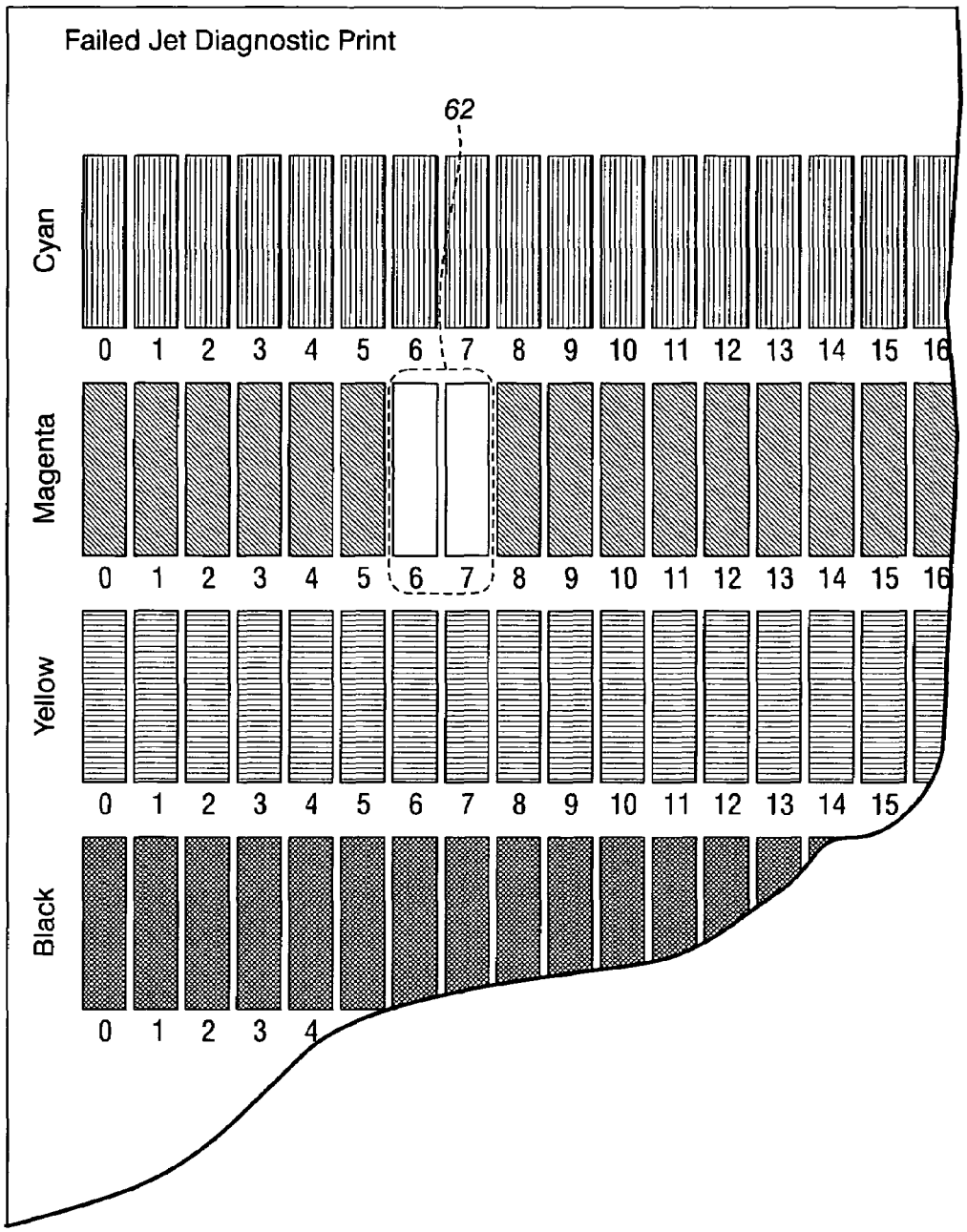
FIG. 3 illustrates an example of a diagnostic test print.
Figure 4:
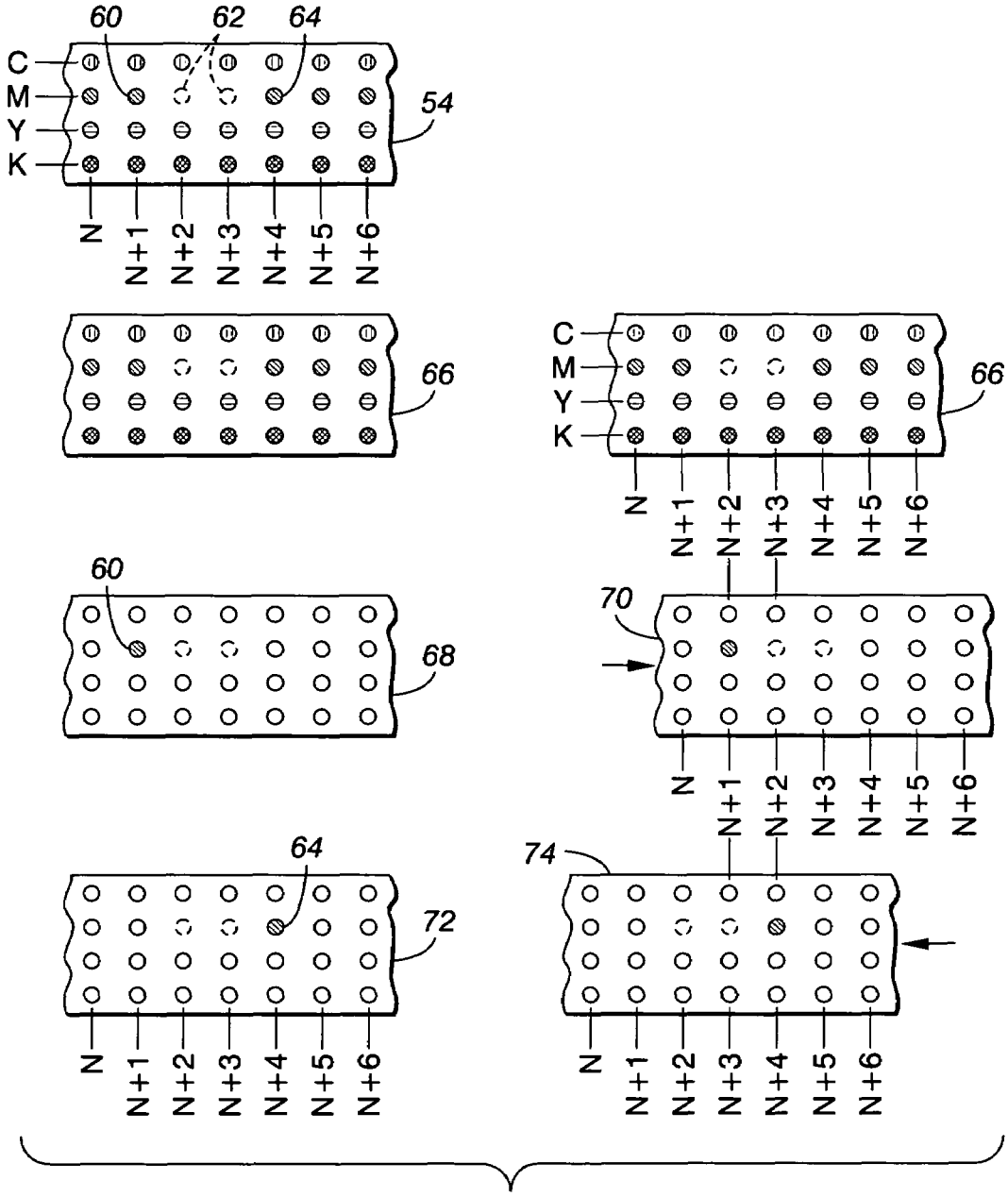
FIG. 4 diagrammatically illustrates jet usage during jet substitution.

Referring now to FIGS. 2 through 4, the microscopic orifices 54 of printhead 11 are arranged in rows for emitting color ink in a CMYK (cyan, magenta, yellow and black) scheme wherein each color orifice is separated a distance 58 by column 56. Image rendering and handling software commands a print engine (not shown) located as part of the printer 10 to enable or disable user-selected jets. The image rendering and handling software contains one or more Page Description Languages (PDL), such as PostScript, as well as a front panel control (not shown) located on the exterior of the printer for user interaction. This enabling and disabling can be done either through front panel controls or through the use of print jobs using product specific commands. Once the user selected jets are determined to be nonfunctioning or to have failed 62 and one or more non-failed jets 60, 64 neighboring the failed jet are able to substitute for the failed jet 62, subsequent print jobs will command the print engine with a flag indicating whether or not the print engine may perform failed jet substitution. The default print command is for the print engine to perform jet substitution when one or more jets are disabled. User developed print files may command the printer to not perform jet substitution.

Figure 5:
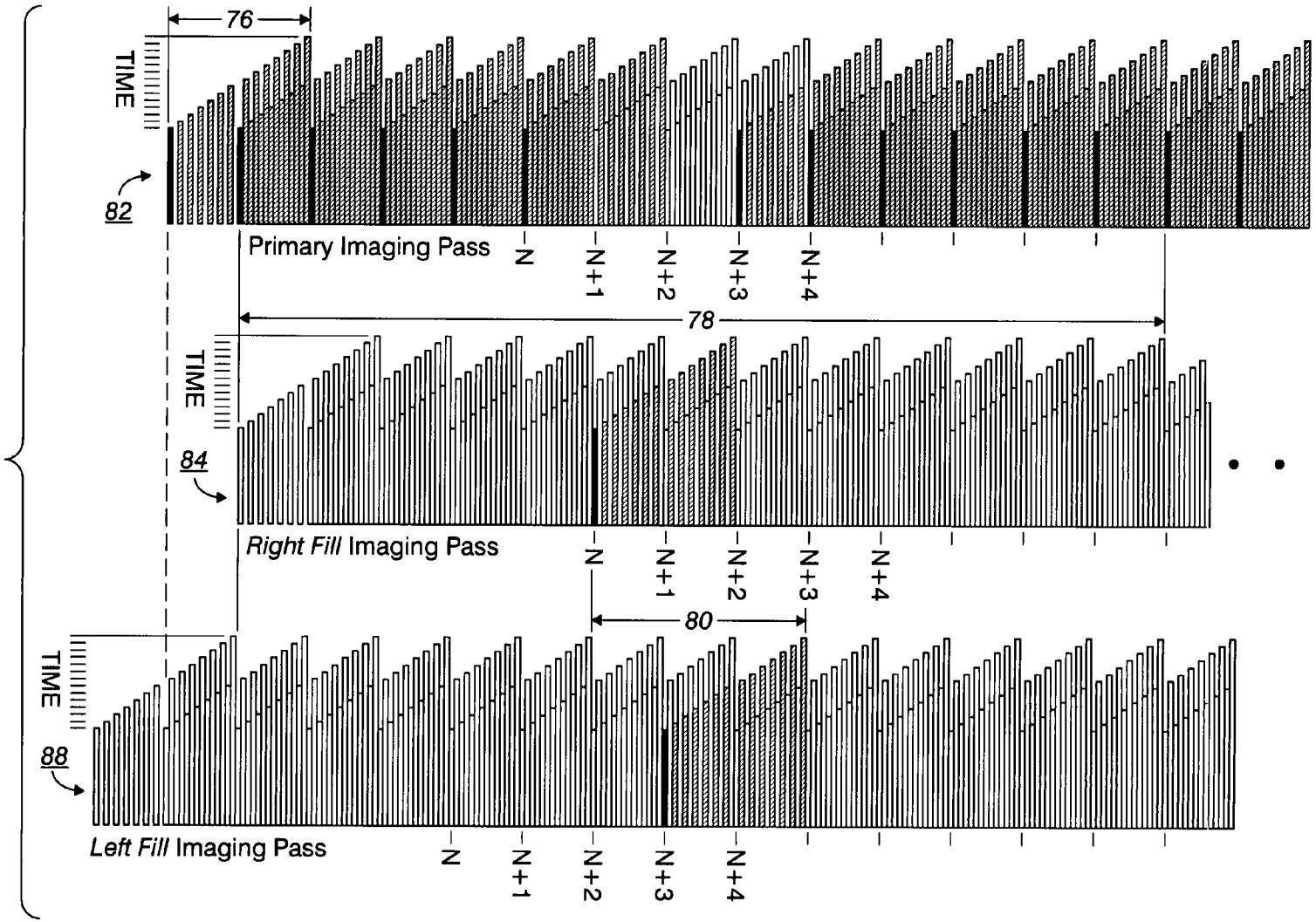
FIG. 5 graphically illustrates an example of how jets deposit ink during imaging.

More specifically, an imaging pass is defined as the motion of the printhead as it moves 42 across the drum 14 at X pixels per unidirectional drum revolution 15 for N rotating drum revolutions. X has values of one (1) or greater, limited by the amount of head travel 50 available. When X is greater than one, vertical image rasters, parallel to the feed direction of the media 19, are deposited in an interlaced fashion on the drum 14 since each jet will pass into the area where the neighboring jet deposits ink. In some cases, one or more additional head positioning adjustments are made during imaging to avoid one jet depositing ink where another jet has already deposited ink. An example of a two pixel interlace (X=2) with a single pixel positioning adjustment after the 7th drum revolution is shown in FIG. 5. N is determined by two factors: the physical spacing of the jet orifice columns 58 on the front of the print head and the horizontal resolution 50 of the printed image.

During each drum revolution 15, each individual jet orifice emits ink of an assigned color creating a scanline 56, or vertical image raster, of that particular color on the surface of the drum 14. Since there are groupings of jets that are lined up vertically in a column, with one of each of the ink colors in that column, each scanline deposited during that drum revolution will be completely imaged. These scanlines are parallel to the feed direction of the media. As each additional drum revolution 15 is performed, more of the image is placed on the drum surface. Once all drum revolutions have been performed for the imaging pass, all ink for the imaging pass has been deposited on the drum surface, resulting in a completed image on the intermediate transfer layer 12 on the printing substrate 19.

The primary imaging pass is the first imaging pass in which all enabled jets are used to deposit ink on the drum. If there are no disabled jets, the image on the drum will be complete. If there are disabled jets and jet substitution is being performed, the primary imaging pass will deposit ink on the drum only for the enabled jets. One or more secondary imaging passes will be performed after the primary imaging is complete to fill in where the disabled jets should have deposited ink during the primary imaging pass using only neighboring jets.

Figure 6:
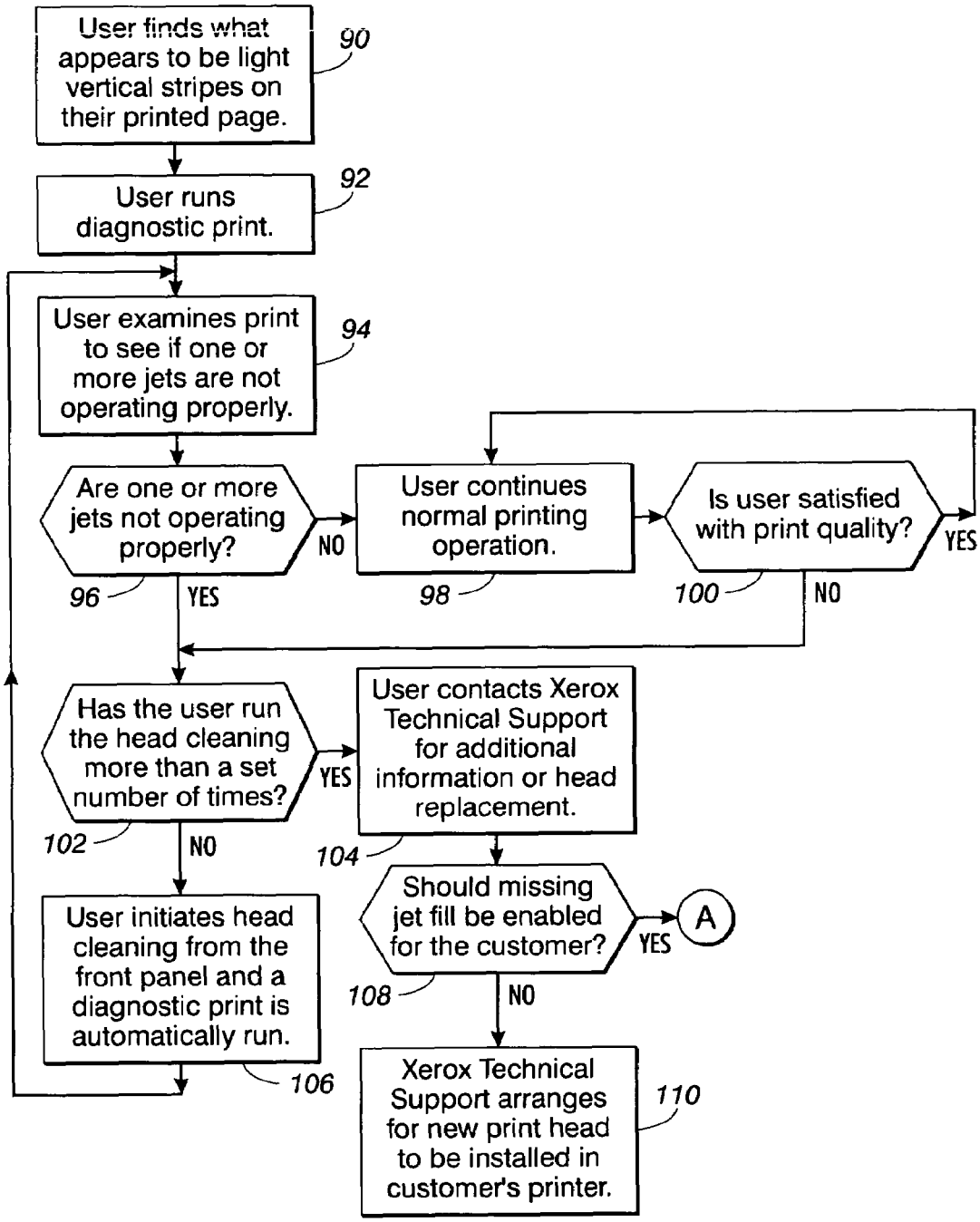
FIG. 6 is a flowchart for the method of determining if jet substitution should be used.
Figure 7:
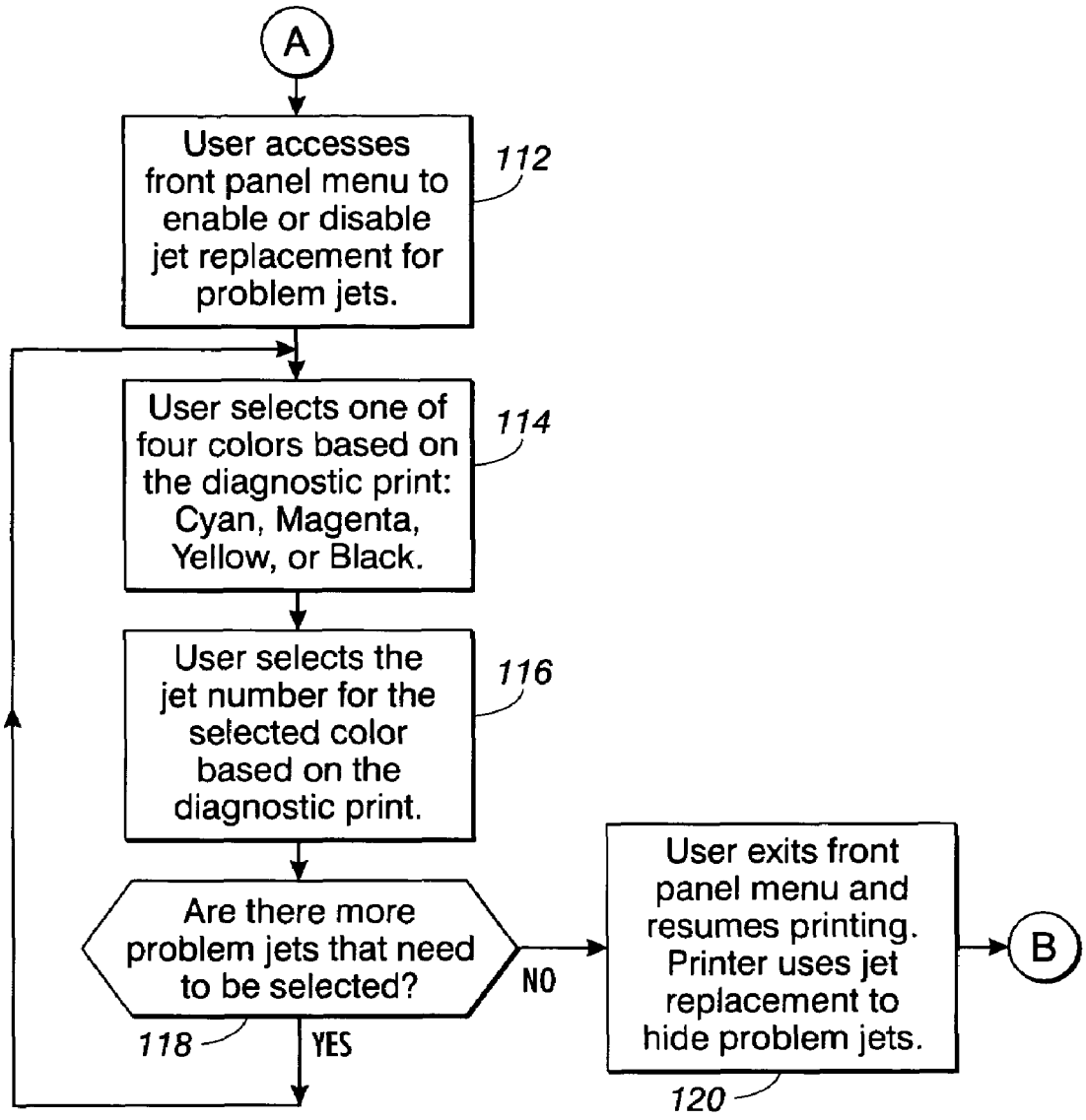
FIG. 7 is a continuation of the flowchart of FIG. 6 for the method of enabling and disabling missing jet substitution.
Figure 8:
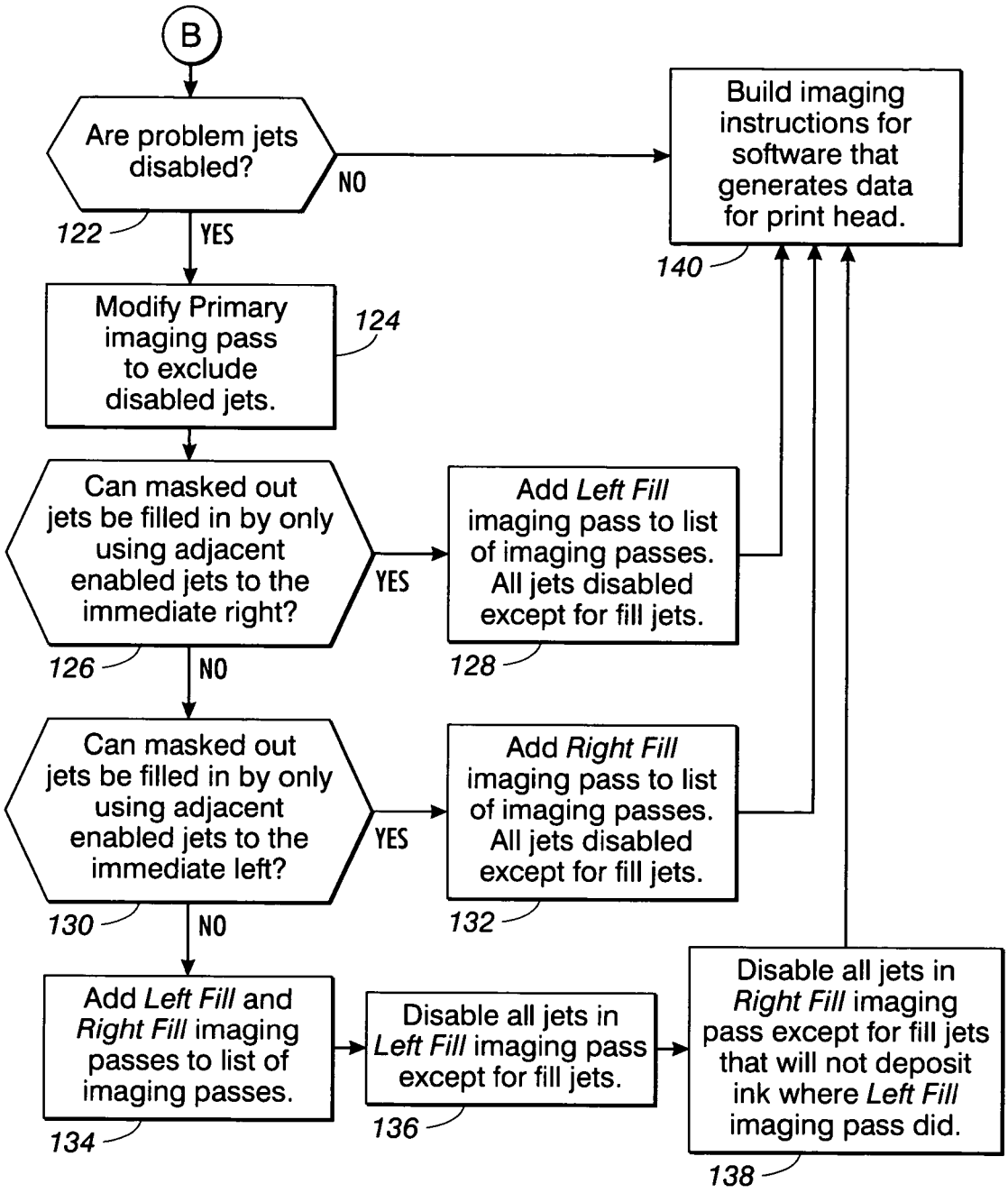
FIG. 8 is a continuation of the flowchart of FIG. 7 for missing jet substitution.

A further detailed description of the methods in embodiments will now be more fully described using the flowcharts shown in FIGS. 6 through 8. With reference to FIG. 3 when the user notices print artifacts on printed pages 90, characterized by missing ink or incomplete ink coverage and often seen as unexpected white streaks on the page, they will execute a diagnostic print 92. As shown in FIG. 3, the jet diagnostic print is used to determine 94 if and which jets are failing 62. If no jets are found to be defective 96, then the user will ensure all jets are enabled and resume normal printing operation 98.

However, if the user finds 96 on the test print that one or more jets that are not functioning properly, indicated by visually by, but not limited to, no ink present, incomplete ink coverage, or improperly positioned ink, then the user will inmate a head cleaning sequence 102 using the front panel to attempt to recover the failed jets. After each cleaning 106, a diagnostic test page is printed for the user. If the failed jets are not recovered, or the image quality remains unacceptable, the user will repeat the cleaning steps a given number of times or until the failed jets are recovered. If cleaning the printhead resolves 100 the problem, then the user will ensure all jets are enabled and resume normal printing 98.

If cleaning the printhead does not resolve the problem, then the user will contact 104 technical support for assistance. If it is determined 108 that jet substitution should be used, the user, through the use of the front panel or custom print files, will enable jet substitution by commanding the printer to disable the selected failed jets and to substitute the ink the disabled failed jets normally emit during the primary imaging pass 66 using operational neighboring jets 60 or 64 during one or more secondary imaging passes 70 and 74, as shown in FIG. 4 and more fully described below.

Referring to FIG. 7, to disable and enable jets, the user accesses a front panel menu 112. The user then selects 114 one of the colors based on the diagnostic print results. In this case it is Cyan, Magenta, Yellow, or Black. The user then selects 116 the number of the jet based on the diagnostic print. The user determines 118 if there are more problem jets that need to be disabled and if there are continues the selection process until finished. The user now exits the front panel menu and resumes printing 120.

Referring to FIG. 5, if no jets are disabled, then the standard motion of the printhead is used. This is a single pass 76 of the printhead across the imaging drum using all jets and may be referred too as the primary imaging pass 82. If one or more jets are disabled and jet substitution is enabled, then a primary imaging pass 82 is made with all enabled jets used, and then one or more secondary imaging passes (84 or 88 as will be more fully described below) are made with only the neighboring substitution jets being used.

More particularly and turning to FIG. 8, when the image rendering and handling software begins the imaging process, it builds a list of one or more imaging passes for the print engine to perform 140. The first is the primary imaging pass. If no jets are disabled 122, then only this pass is added to the list and all jets are used. If one or more jets are disabled, then the primary imaging pass is placed in the list using all but the disabled jets 124. The image rendering and handling software then examines which jets are disabled and determines the minimum number of secondary imaging passes to perform.

If all disabled jets can be substituted using neighboring jets to the right of the disabled jets 126, a single secondary imaging pass is added to the list. The starting position 80 of the printhead will be to the left of the primary imaging pass such that substituting jets to the right of the disabled ink jets will be starting at the same position that the disabled ink jets of the primary imaging pass started. This is called a left fill imaging pass 128 as shown by the diagram 88 in FIG. 5 and illustrated by ink jets 74 in FIG. 4.

If a single left fill imaging pass cannot substitute all disabled jets, then a check is made to see if all disabled ink jets can be substituted using neighboring ink jets to the left of the disabled ink jets 130, and if so, a single secondary pass is added to the list. The starting position 78 of the printhead will be to the right of the primary imaging pass such that the substituting jets to the left of the disabled jets will be starting at the same position that the disabled jets of the primary imaging pass started. This is called a right fill imaging pass 132 as shown by the diagram 84 in FIG. 5 and illustrated by ink jets 70 in FIG. 4.

If a single right fill imaging pass is insufficient then a combination 134 of the left fill and right fill imaging passes will be added to the list, where some of the disabled jets are substituted by the left fill imaging pass 136 and the remaining portion is substituted by the right fill imaging pass 138.

The order of selecting the fill is irrelevant. Left fill may be chosen and/or performed before or after right fill. Depending on the availability of neighboring jets and the limitations of head travel, it may not be possible to substitute all failed jets.

Additionally, it should be noted that depending on the color of the failed jet, it is possible to substitute the jet with a combination of different colors. An example of this is to use a combination of Cyan, Magenta, and Yellow to replace a failed Black jet with a Composite Black. By way of example and not of limitation, if the failed jet is black, it can be filled in with a combination of cyan, magenta and yellow without additional imaging pass. When the user has enabled the methods for jet replacement on a printer (i.e.—recognizing image artifacts on the printed page indicating a failed jet and then replacing it with a neighboring jet) then the printing speed is reduced approximately proportional to the number of passes required. For example, a second imaging pass will require approximately twice as long to print the image as compared to a single pass image. Therefore, by preprocessing or by doing parallel processing of the image during printing it may be determined if the jet substitution mode has been enabled and whether a replaced jet is used in the image. If the replaced jet is not used, then the second or multiple additional passes are not required. This will result in printer throughput that is only slightly slower than the original throughput, due to the additional image processing. The user may enable and disable the image rendering and handling software through the front panel. For example, if a new head is installed, all jets will be enabled automatically allowing full speed printing.

The actual methods of detecting and replacing jets can have other embodiments depending on the architecture of the printer. For example, in a printer architecture with additional print head travel, it is possible to position the printhead in the secondary pass to fill in multiple jets without requiring a third pass.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method comprising:

performing a primary image pass to print a plurality of scan lines using enabled ink jets; and performing one or more additional imaging passes to print additional scan lines to fill in for one or more disabled ink jets using one or more of the enabled ink jets wherein the additional scan lines would normally be printed by the one or more disabled ink jets if they were operative, including, performing a left imaging pass by starting a secondary imaging pass right of the primary imaging pass such that the enabled neighboring operational ink let is lined up horizontally where the disabled ink jet started on the primary imaging pass, and/or a right imaging pass by starting a secondary imaging pass left of the primary imaging pass such that the enabled neighboring operational ink jet is lined up horizontally where the disabled ink jet started on the primary imaging pass.

2. The method according to claim 1, further comprising:

determining if at least one or more ink jets are improperly functioning and disabling the one or more improperly functioning ink jets.

3. The method according to claim 2, wherein response to a determination that one or more ink jets are improperly functioning, determining whether or not one or more other operational ink jets are of a same color which may replace the one or more improperly functioning ink jets.

4. The method according to claim 3, wherein response to a determination that one or more other operational ink jets of the same color may fill in for the one or more improperly functioning ink jets, disabling the one or more improperly functioning ink jets and performing a primary image pass followed by one or more additional imaging passes to fill in for the one or more disabled ink jets by enabling the one or more other operational ink jets of the same color.

5. A method comprising:

depositing a plurality of scan lines on a unidirectionally rotating print surface using enabled ink jets; and depositing a plurality of additional scan lines on the unidirectionally rotating print surface using one or more of the enabled ink jets wherein the plurality of additional scan lines would normally be printed by disabled ink jets if they were operative so that the one or more enabled ink jets fill in for the one or more disabled ink jets by performing a left imaging pass by starting a secondary imaging pass right of the primary imaging pass such that the enabled neighboring operational ink jet is lined up horizontally where the disabled ink jet started on the primary imaging pass, and/or a right imaging pass by starting a secondary imaging pass left of the primary imaging pass such that the enabled neighboring operational ink jet is lined up horizontally where the disabled ink jet started on the primary imaging pass.

6. The method according to claim 5, further comprising:

determining if at least one or more ink jets are improperly functioning and disabling the one or more improperly functioning ink jets.

7. The method according to claim 6 further comprising:

depositing the plurality of additional scan lines by performing a left imaging pass such that the one or more enabled ink jets line up horizontally where the one or more disabled ink jets would normally be printed by the one or more disabled ink jets.

8. The method according to claim 6 further comprising:

depositing the plurality of additional scan lines by performing a right imaging pass such that the one or more enabled ink jets line up horizontally where the one or more disabled ink jets would normally be printed by the one or more disabled ink jets.

9. The method according to claim 6, further comprising:

depositing the plurality of additional scan lines by performing a left imaging pass such that the one or more enabled ink jets line up horizontally where the one or more disabled ink jets would normally be printed by the one or more disabled ink jets; and depositing the plurality of additional scan lines by performing a right imaging pass such that the one or more enabled ink jets line up horizontally where the one or more disabled ink jets would normally be printed by the one or more disabled ink jets.

10. The method according to claim 5 further comprising:

substituting the one or more disable ink jets with a combination of different colors using the one or more operational ink jets.

11. A printer comprising:

a print engine having image rendering and handling software commands to enabled or disabled one or more user selected jets wherein once user selected jets are determined to have failed one or more non-failed jets neighboring the one or more failed jets are enabled to substitute for the one or more failed jets, wherein subsequent print jobs command the print engine with a flag indicating whether or not the print engine may perform failed jet substitution.

12. The printer according to claim 11 wherein the image rendering and handling software contains one or more Page Description Languages.

13. The printer according to claim 11 wherein a front panel control for user interaction is provided to enabled or disabled one or more user selected jets.

14. The printer according to claim 11 wherein print jobs using product specific commands are used to enabled or disabled one or more user selected jets.

15. The printer according to claim 11 wherein a default print command is used for the print engine to perform jet substitution when one or more jets are disabled.

16. The printer according to claim 11 wherein user developed print files command the print engine to not perform jet substitution.

* * * * *